US006379404B1

(12) United States Patent
Ru

(10) Patent No.: US 6,379,404 B1
(45) Date of Patent: Apr. 30, 2002

(54) ADDITIVE USED IN THE COMBUSTIBLE WATER/HYDROCARBON FUEL MIXTURE

(76) Inventor: Zhang Zheng Ru, #603 Chong-Mei Village, Beijing (CN)

( * ) Notice: Subject to any disclaimer, the term of this patent is extended or adjusted under 35 U.S.C. 154(b) by 0 days.

(21) Appl. No.: 09/430,276

(22) Filed: Oct. 29, 1999

(51) Int. Cl.[7] ..... C10L 1/32

(52) U.S. Cl. ..... 44/301; 44/370; 44/434; 44/436; 44/437; 44/442

(58) Field of Search ..... 44/301, 322, 370, 44/434, 436, 437, 442

(56) References Cited

U.S. PATENT DOCUMENTS 3,615,295 A * 10/1971 Manary, Jr.
3,649,527 A * 3/1972 Pitchford et al. ..... 208/217
4,045,188 A * 8/1977 Hirschey
4,104,036 A * 8/1978 Chao et al.
4,286,969 A * 9/1981 Medcalf
4,359,969 A * 11/1982 Mellovist et al. ..... 123/1 A
5,482,518 A * 1/1996 Poirier ..... 44/312

FOREIGN PATENT DOCUMENTS

JP 05263096 A * 10/1993
SU 1461763 A * 2/1989

* cited by examiner

*Primary Examiner*—Margaret Medley
(74) *Attorney, Agent, or Firm*—Chi Ping Chang; Pacific Law Group LLP

(57) ABSTRACT

This invention provides an additive used in the water/oil mixture to form an emulsified water/oil mixture suitable as a fuel source. The additive comprises a nonionic surfactant selected from the group of chemicals consisting of 55–65% of phenyl ethyl phenyl polyethyleneoxide and at least one ionic surfactants selected from the group of chemicals consisting of 18–30% of metaldehyde, 3–5% of peroxybenzoic acid and 4–12% of 1,4-dihydroxybenzene by weight of said additive. The additive enables the emulsified water/oil mixture to accommodate allowable water ratios from about 15% up to about 50% to achieve a fuel reduction rate of about 15–30% as compared to a conventional fuel source comprise solely of the crude oils.

10 Claims, 1 Drawing Sheet

ADDITIVE USED IN THE COMBUSTIBLE WATER/HYDROCARBON FUEL MIXTURE

FIELD OF INVENTION

Figure 1:
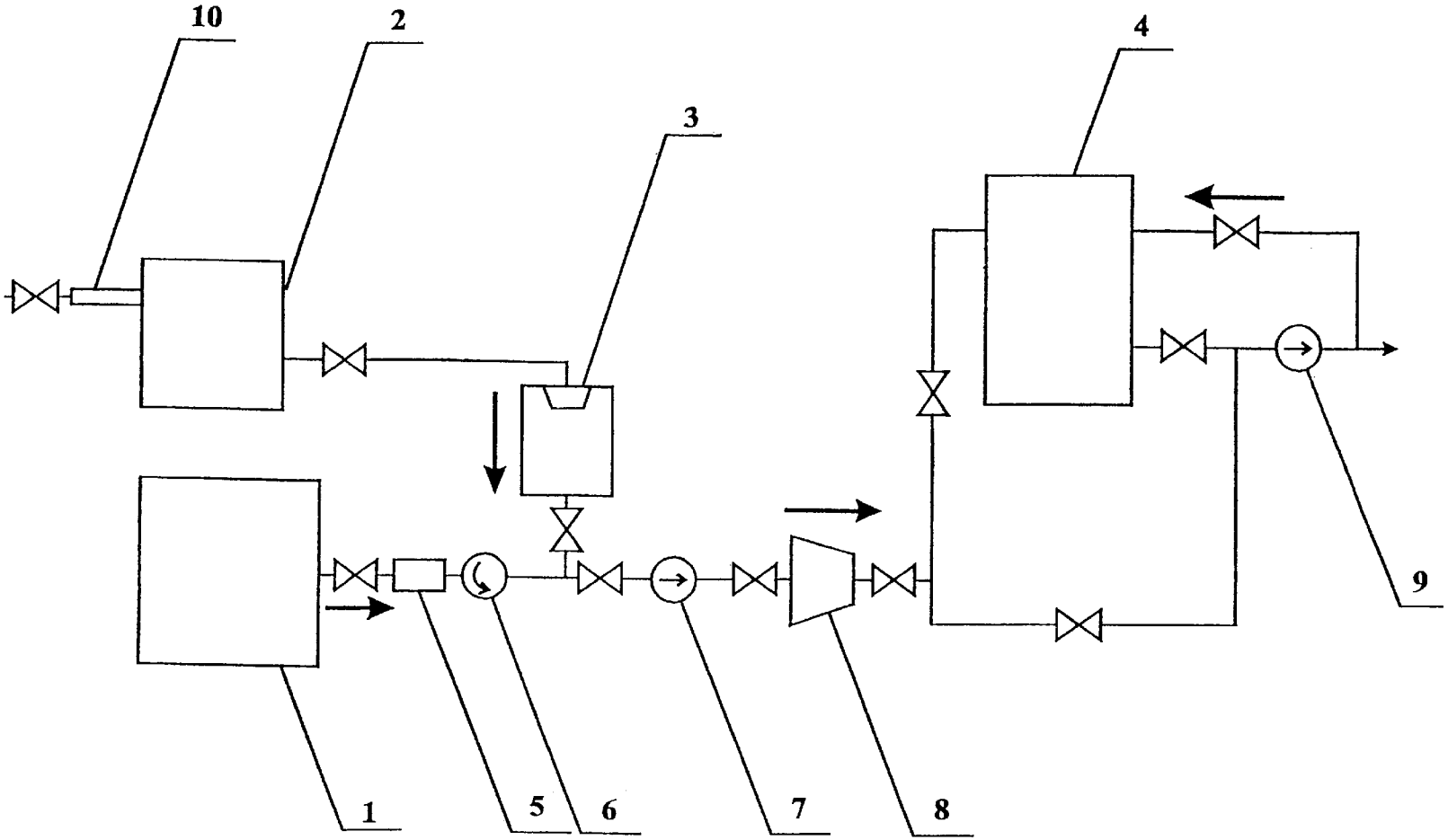

The present invention relates to hydrogenation of hydrocarbon/water mixture as combustible fuel. In particular, it relates to a series of additives used in the hydrogenation of the combustible hydrocarbon/water fuel mixture to achieve remarkably higher fuel efficiency while reducing the level of gaseous wastes undesirable to the environment.

BACKGROUND OF INVENTION

There exist enormous interests in utilizing the mixture of hydrocarbons and water to develop a more efficient and clean fuel source that will not only reduce fuel consumption, but also emit less gaseous wastes such as $SO_2$, NO and CO after combustion. A number of chemical and physical processes have been developed for such purposes. U.S. Pat. No. 4,743,357 (Patel et al) discloses a catalytic process for producing light hydrocarbons from heavy hydrocarbons by treatment of the latter with water in the presence of an effective amount of selected catalytic materials such as iron oxides or sulfides at elevated temperatures and pressures. U.S. Pat. No. 3,649,527 discloses steam treatment of sulfur-containing heavy crude oil with a combination of catalysts comprising a hydrogenation-desulfurization catalyst and others to generate in situ hydrogen, thus reducing the specific gravity and sulfur content of the crude oils. The utilities of the aforementioned methods are somehow inconveniently limited as they required a prolonged pre-treatment of the heavy oils/water mixture under elevated temperatures and pressures in presence of certain catalysts.

There are yet other employed methods or formulations aimed at the development of the oil/water mixture as an alternative fuel. Notably, these methods and formulations focused primarily on the use of chemical emulsifiers, and in some instances, in combination with mechanical tools to generate emulsified water/oil mixtures. As the formation of such prior art water/oil mixtures relies primarily on the physiochemical property of the emulsifiers, the water ratios achievable in such emulsified water/oil mixture are generally limited by the chemical compatibility of the emulsifiers with the oils. Consequently, the maximum water ratios achievable in such emulsified mixture are reportedly limited to a range of 10–20% by weight, which will give rise to only about 10% of fuel reduction as compared to a conventional fuel source comprising solely of the crude oils.

There is therefore an apparent need for an emulsified water/oil mixture suitable as a fuel source which is readily employable and usable by any forms of existing fuel generating facilities without subjecting the water/oil mixture to a prolonged pre-treatment under elevated temperatures and pressures in presence of any catalysts.

There is another need for an emulsified water/oil mixture suitable as a fuel source in which the maximum allowable water ratios in such emulsified mixture are enhanced by an additive to a range of 15–50% by weight to achieve a fuel reduction rate at about 15–30% as compared to a conventional fuel source comprising solely of the crude oils.

There is a further need for an emulsified water/oil mixture suitable as a fuel source from which the post combustion gaseous wastes such as $SO_2$, NO and CO are significantly reduced so as to provide a clean and environmentally desirable fuel source.

It is therefore an object of the present invention to provide for a novel additive used in the water/oil mixture to form an emulsified water/oil mixture suitable as a fuel source.

It is another object of the invention to provide for a novel additive comprising nonionic and/or ionic surfactants sufficient to increase the maximum allowable water ratios in the emulsified water/oil mixture without compromising its fuel efficiency thereby decreasing fuel consumption.

It is a further object of the invention to provide for a water/oil mixture comprising the additive to achieve high fuel efficiency while reducing the amount of gaseous wastes emitted to the environment as compared to the oil alone as a combustible fuel.

SUMMARY OF THE INVENTION

This invention relates to a novel additive used in the water/oil mixture to form an emulsified water/oil mixture suitable as a fuel source exhibiting high fuel efficiency while reducing gaseous wastes as compared to the oil alone as a combustible fuel.

One aspect of the invention is to provide for an additive used in the water/oil mixture to form an emulsified water/oil mixture suitable as a fuel source. The additive comprises a nonionic surfactant selected from the group of chemicals consisting of 55–65% phenyl ethyl phenyl polyethyleneoxide and at least one ionic surfactants selected from the group of chemicals consisting of 18–30% of metaldehyde, 3–5% of peroxybenzoic acid and 4–12% of 1,4-dihydroxybenzene by weight of said additive.

Another aspect of the invention is to provide for a water/oil mixture as a combustible fuel exhibiting high fuel efficiency while reducing gaseous wastes as compared to the oil alone as a combustible fuel. The preferred water/oil mixture comprises the aforementioned additive in an amount of 0. 1–0.3% by weight of the water/oil; water in an amount of 15–50%; and oil added and mixed as the residual amount by weight percent of said water/oil mixture to form an emulsified water/oil mixture.

According to the invention, the maximum allowable water ratios in the emulsified water/oil mixture aided by the additive are in a range of 15–50% by weight so as to achieve a fuel reduction rate at about 15–30% as compared to a conventional fuel source comprising solely of the crude oils.

DETAILED DESCRIPTION OF INVENTION

EXAMPLE I

The Composition and Preparation of the Preferred Additives As Surfactants For Water/Oil Mixture According to the Invention A preferred embodiment of the additive to the water/oil mixture according to this invention comprises a mixture of a group of chemicals consisting by weight percentage of 55–65% of polyethylene-type nonionic surfactants, polyaldehyde 18–30%, organic peroxide 3–5%, dihydrobenzene and hydroquinone 4–12%. Among these chemicals, the polyaldehyde is preferably a metaldehyde or tetrameracetaldehyde. In addition, each of the aforementioned chemicals can be prepared and mixed with others in a variety of percentages and combinations to form an additive suitably added to a water/oil mixture to make full utility of the oil portion of the water/oil mixture for the production of a high efficiency fuel. The water used in the water/oil mixture according to the invention could be of any forms and sources including, but without limitation to, the tape water, well water, river water, distilled water or rain water. Prior to the addition of water to the oil, the water is preferably magnetized to produce highly magnetized water, which is subsequently undergone a series of reaction to generate H, HO and CO during the burning process to achieve a high fuel efficiency.

When preparing the water/oil mixture fuel provided by the invention, the magnetized water is first mixed with the crude oil in the presence of one or more surfactants to form a homogenous, emulsified mixture. According to the invention, this can be readily achieved by addition of the provided additives as nonionic surfactants to facilitate the emulsification process. The nonionic surfactants generally provide a broader range of activities and are easily mixed with a variety of emulsifiers. A preferred nonionic surfactant consisting of a group of chemicals selecting from the group of polyethylene. A preferred polyethylene is phenylethyl phenyl polyethyleneoxide.

In addition to the nonionic surfactants, one or more other types of surfactants can be used concurrently with the nonionic surfactants as a surfactant complex to enhance the efficiency of emulsification. For examples, the aforementioned nonionic surfactants can be suitably mixed with ionic surfactants such as anionic or cationic surfactants to form a surfactant complex. Notable examples of such anionic or cationic surfactants are tris(-2-hydroxyethyl)amine or Triethanolamine, calcium dodecyl sulfonate. Since most of the emulsified systems appear to be thermally unstable and tend to break the emulsified water/oil solution under elevated heat or temperature conditions, it is therefore highly desirable to form an emulsification system that could better endure heat. One solution for this need is to form a thermally more stable micro-emulsified water/oil system that is made of smaller emulsified water/oil droplets or particles having diameters between 1 to 2 u. To achieve such purposes, the tris(-2-hydroxyethyl)amine or calcium dodecyl sulfonate is particularly useful to form such micro-emulsification system.

The formation of the micro-emulsified water/oil system employing either the tris(-2-hydroxyethyl)amine or calcium dodecyl sulfonate as surfactants provides further advantages. According to the invention, the inclusion of the tris(-2-hydroxyethyl)amine or calcium dodecyl sulfonate as additives to the water/oil mixture will not only increase its fuel efficiency, but also reduce the release of the hazardous gaseous pollutants such as $SO_2$ into the environment. More specifically, the $SO_2$ will react with calcium to form fine particles of calcium salts and thus reduces the amount of gaseous $SO_2$ releasable to the air. When preparing the micro-emulsified water/oil fuel employing a surfactant complex as the additive, the surfactant used in the complex may be of different amounts and of different types in accordance with the need. Using the total weight of the additive as the basis, the amount of the nonionic surfactants used in the complex is preferably in a range of 28–35% by weight and the amount of the ionic surfactants is preferably in a range of 27–30% by weight.

Once the emulsified water/oil fuel is formed and settled to a homogenous mixture, it is readily usable as a fuel system. The emulsification enables the small water/oil droplets to exist in a physical relationship that the spherical surface of the water droplet is virtually surrounded by and enclosed within the oil droplet. This physical relationship allows each of the water/oil droplets to easily undergo a process of "micro-explortion" under a high temperature to convert the water/oil droplets into the so-called "secondary gasified vapors". This process enables the oil portion of the water/oil mixture to be well and evenly distributed in a fuel burning system to achieve a high burning efficiency resemble the conventional gas system. In a preferred embodiment of the invention, the water is magnetized prior to being added to facilitate a subsequent water degradation process. When the water/oil mixture is later subject to a temperature condition above the threshold temperature, the water portion of the water/oil mixture will be vaporized or steamed to produce sufficient water vapors and steam, adding additional efficiency to the characteristics and effect of the aforementioned gas system. Furthermore, in the presence of sufficient $O_2$, the water vapors and steam will aid the catalytic conversion of the crude oil to CO and $H_2$ at a temperature condition above the threshold temperature to form a steam/gas system in accordance with the following formula:

$$mC+mH_2O \rightarrow mCO+mH_2 \quad (1)$$

$$mCO+ml/2O_2 \rightarrow mCO_2 \quad (2)$$

$$nH_2+n/2O_2 \rightarrow nH_2O \quad (3)$$

The steam/gas system generated according to the formula allows a burning or combustion device or facility to make full advantage of the water/oil mixture to achieve high efficiency use of the fuel. In order to enhance further the effect of the steam/gas system, the additive provided by the invention may further comprise an organic peroxide. The organic peroxide preferably has a reasonably higher degradation temperature and a reasonably longer half-life so as not to be degraded prematurely during the burning process. Accordingly, the preferred organic peroxide according to the invention comprises at least one member selected from the group consisting of peroxybenzoic acid, tert-Butyl peroxide or di-tert-butyl peroxide according to the invention.

The additive provided by the invention may further comprise a series of chemicals selected from the group consisting of hydroquinone or dihydroxybenzene to eliminate or otherwise to minimize a generally known problem associated with the formation of tars or solid particles as a result of the combustion of crude or other heavy oils. This problem arises from an earlier polymerization of certain unsaturated components or unsaturated hydrocarbons existed in the oils when the oil is subject to high temperatures. Once the polymerization process commences, that portion of oils will be solidified and thus be prevented from participating in the burning, and therefore will reduce the overall efficiency of the fuel. The addition of any of the chemicals selected from the group consisting of hydroquinone or dihydroxybenzene as the additive therefore provides an additional advantage to the water/oil mixture by preventing the earlier polymerization of the unsaturated components or unsaturated hydrocarbons. The preferred hydroquinones are 1,4-dihdroxybenzene and 2,5-di-tert-butyl-hydroquinone. The amounts of such hydroquinone chemicals used in the water/oil mixture will depend on the amounts of the unsaturated components present in the oils.

The additive provided by the invention may further comprise a series of chemicals selected from the group consisting of polyaldehyde that is known to produce a very high thermal value or energy. A preferred polyaldehyde used by the invention is tetrameracetaldehyde, which is generally known as "solid alcohol" capable of producing a very high thermal value upon burning. In particular, the tetrameracetaldehyde will participate fully in the burning process and leaves no residual contaminant post burning, which causes no or little chemical deterioration to the burning devices.

EXAMPLE II

The Preparation and Mixing of Water and Oil with the Additive to Form Emulsified Water/Oil Mixture FIG. 1 illustrates generally the flow chart for the production, mixing and use of water/oil mixture provided by the invention. It should be noted that the water/oil mixture could be made and adjusted in accordance with the type of burning devices as well as the types of fuels as desired. The desirable amount of water and the water: oil ratios thereof can be adequately adjusted by the use of a proper additive. Once the proper ratio of water and oil is determined, the oil is filled into the oil tank 1 or an alike storage device. The water is filled into a water tank 2 or an alike container. A magnetizing device 10 is installed on the water tank 2 to magnetize the water to produce magnetized water, which will flow through a water flow meter 3 prior to being mixed with the oil. The oil will flow out of the oil tank 1 through a filter 5 and a flow control meter 6 before it will begin to mix with the water flowed from the water flow meter 3. The water and oil will be transported by the action of a geared pump 7 to a mixer 8 at where the water and oil will be fully mixed to form desirable emulsified water/oil mixture. The emulsified water/oil mixture is transported to a fuel storage tank or an alike container 4 from where the water/oil mixture will be transported to a fuel igniter or a burning device through the action of a fuel pump 9. The additive and surfactants provided by the invention can be added either directly to the water in the water tank 2 or to the oil in the oil tank 1. The additive will be subsequently transported to the mixer 8 to facilitate the formation of emulsified water/oil mixture. The magnetizing device 10 can be any device suitably adopted to magnetize the water and can produce a magnetic force about 4000 to about 5000 Gauss. The fuel igniter or the burning device can include, without limitation to, an internal combustion engine, a boiler/generator, a combustion chamber or a burner of a furnace.

EXAMPLE III

Evaluation of the Fuel Efficiency, Gaseous Waste Release and Fuel Conservation of the Emulsified Water/Oil Mixture in the Presence of the Additive Table 1 shows the test results of the water/oil mixture comprising (by weight percent of the mixture) 35% of magnetized water, 0.2% of the additive and the crude oil used as the fuel source in a pottery manufacture plant in China. The emulsified water/oil mixture was tested side-by-side in the plant with a control treatment that contains the crude oil alone in a burning devices to generate heat for drying, baking and manufacturing of the pottery. The water/oil mixture and the crude oil are evaluated for their respective fuel efficiency and gaseous pollutant emission. The tests were conducted according to the standard industry boiler/generator thermal test method. The steam pressure is maintained at 0.4 MPa. The oil pressure is maintained at 1.0 MPa. The fuel nozzle remains constant regardless of the variation of the weight percent of the water and its pressure is maintained at 1.2 MPa. The emulsified water/oil mixture is maintained at 80–85° C. The results showed that when the crude oil is mixed with 35% of magnetized water in the presence of 0.2% of the additive provided by the invention, the water/oil mixture achieved 26% oil conservation rate as compared to the control oil alone. In addition, the amounts of gaseous wastes such as CO, CH and $SO_2$ released from the water/oil mixture were significantly reduced as compared to those released from the crude oil alone. It is concluded that the water/oil mixture prepared according to the invention provides not only substantial conservation of oil, but also reduces significantly the amount of environmental pollutants emitted from the combustion.

TABLE 1

The Result of Test Burning of Water/Oil Mixture for Fuel Efficiency and Waste Release

| Treatment | Oil Consumption (kg) | Water Added (%) | Additive Added (%) | Boiler temperature (° C.) | *Oil Reduction Rate (%) | Waste Released CO (%) | CH (ppm) | $SO_2$ (mg/m$^3$) |
|---|---|---|---|---|---|---|---|---|
| Oil Only | 610 | 0 | 0 | 1340 | — | 0.025 | 30 | 7.50 |
| Water/Oil Mixture | 449.3 | 35 | 0.2 | 1340 | 26.34 | 0 | 0 | 2.95 |

*When the boilers for the oil only and water/oil mixture reach the same temperature, the Oil Reduction Rate is computed as follows: (the amount of crude oil used - the amount of water/oil mixture used) × 100% the amount of crude oil used By way of illustration, not by way of limitation, the additive as used herein comprises at least one member of the surfactants preferably selected from the group of chemicals consisting of phenyl ethyl phenyl polyethyleneoxide, tris-(2-hydroxyethyl)amine, calcium dodecyl sulfonate, peroxybenzoic acid, tert-butyl peroxide, 2,5-di-tert-butyl hydroquinone, 1,4-dihydroxybenzene or metaldehyde as set forth in Table 2. These chemicals are expressed in percentage weight of the total weight of the additive, which is in turn based on about 0.1% to about 0.3% of the total weight of the water/oil mixture. A preferred percentage weight of the additive according to the invention is 0.2%. As noted from Table 2, the constituent chemicals of the additive may be varied in weights and in combinations pursuant to the purposes and needs of the fuel requirements. The examples listed in Table 2 are therefore intended merely for the purposes of illustration and should not be construed as a limitation to the scope of the invention.

TABLE 2

The Preferred Composition of Additive Used in the Oil/Water (by % weight of the Additive)

| Chemicals | Example 1 | Example 2 | Example 3 | Example 4 |
|---|---|---|---|---|
| Phenyl ethyl phenyl polyethyleneoxide | 45 | 40 | 45 | 40 |
| Tris-(2-hydroxyethyl)-amine | 20 | 25 | 0 | 0 |
| Calcium dodecyl sulfonate | 0 | 0 | 16 | 22 |
| Peroxybenzoic acid | 5 | 3 | 4 | 0 |
| Tert-butyl peroxide | 0 | 0 | 0 | 5 |
| 2,5-di-tert-butyl hydroquinone | 12 | 7 | 0 | 3 |
| 1,4-dihydroxybenzene | 0 | 0 | 12 | 0 |
| Metaldehyde | 18 | 25 | 23 | 30 |

The emulsified water/oil mixture according to the invention is further evaluated side-by-side with crude oil alone in a fuel injection-type dry tower burner for eight hours for its fuel efficiency and environmental benefits. As shown in Table 3, the water/oil mixture comprising 30% of magnetized water and 0.2% of the additive achieves a 21.73% of oil conservation rate. The gaseous wastes released from the water/oil mixture vent are reduced about 73.73% for $SO_2$, 7.7% for $NO_x$ and 33.3% for CO respectively as compared to those released from the crude oil only vent. The emulsified water/oil mixture provided by the invention is therefore environmentally desirable as an alternative fuel source.

TABLE 3

The Result of Test Burning of Water/Oil Mixture in a Fuel Injection Type Burner.

| Treatment | Oil Consumption (kg/Hr) | Water Added (%) | Additive Added (%) | Oil Conservation Rate (%) | Waste Released $SO_2$ | NOx (Kg/h) | CO |
|---|---|---|---|---|---|---|---|
| Oil Only | 364.3 | 0 | 0 | — | 0.33 | 0.26 | 0.18 |
| Oil/water Mixture | 285.15 | 30 | 0.2 | 21.73 | 0.09 | 0.24 | 0.12 |

Table 4 shows a comparison of the average thermal values generated between the emulsified water/oil mixture and the crude oil alone. The water/oil mixture comprising 28% of magnetized water and 2% of the additive exhibits an average thermal value of 38.81 KJ/g while the crude oil alone exhibits an average thermal value of 43.85 KJ/g. The results showed an average of 22.9% reduction in oil consumption by the water/oil mixture provided by the invention based on repetitive tests.

TABLE 4

The Comparisons of the Thermal Value between the Water/Oil Mixture and Oil only.

| Treatment | Water Added (%) | Additive Added (%) | Heat Value (KJ/G) |
|---|---|---|---|
| Oil Only | 0 | 0 | 43.85 ± 0.09 |
| Oil/water Mixture | 18.1 | 0.2 | 36.82 ± 0.14 |
| Oil/water Mixture | 17.2 | 0.2 | 36.57 ± 0.14 |
| Oil/water Mixture | 28.0 | 0.2 | 38.81 ± 0.12 |

In view of the foregoing, the additive provide by the invention, when properly used in conjunction with the water/oil mixture to from an emulsified water/oil mixture, can not only achieve a high fuel efficiency and a high oil conservation rate, but also significantly reduce the undesirable release of the environmental pollutants. The emulsified water/oil mixture can be used in and by the conventional burning device thereby provides an advantageous alternative for the conventional fuels.

Although the preferred embodiment of the invention has been disclosed for illustrative purposes, those skilled in the art will appreciate that various modifications, additions and substitutions are possible, without departing from the scope and spirit of the invention, as disclosed in the accompanying claims

What is claimed is:

1. An additive used in a water/hydrocarbon mixture as a combustible fuel comprises 55–65% of phenyl ethyl phenyl polyethyleneoxide and at least one ionic surfactants selected from the group of chemicals consisting of 18–30% of metaldehyde, 3–5% of peroxybenzoic acid and 4–12% of 1,4-dihydroxybenzene or 2,5-di-tert-butyl hydroquinone by weight of said additive.

2. The additive used in a water/hydrocarbon mixture according to claim 1 wherein the ionic surfactants further comprise 20–35% of tris-(2-hydroxyethyl)amine by weight of said additive.

3. The additive used in a water/hydrocarbon mixture according to claim 1 wherein the ionic surfactants further comprise 15–16% of calcium dodecyl sulfonate.

4. A water/hydrocarbon mixture as a combustible fuel exhibiting high fuel efficiency while reducing gaseous wastes as compared to the hydrocarbon alone as a combustible fuel, comprising;

(a) an additive in an amount of 0.1–0.3% by weight of said water/hydrocarbon wherein said additive comprises 55–65% of phenyl ethyl phenyl polyethyleneoxide and at least one ionic surfactants selected from the group of chemicals consisting of 18–30% of metaldehyde, 3–5% of peroxybenzoic acid and 4–12% of 1,4-dihydroxybenzene or 2,5-di-tert-butyl hydroquinone by weight of said additive;

(b) water in an amount of 15–50% by weight of said water/hydrocarbon mixture; and (c) hydrocarbon is mixed as the residual amount by weight percent of said water/hydrocarbon with said water and said additive to form an emulsified water/hydrocarbon mixture.

5. The water/hydrocarbon mixture as a combustible fuel according to claim 4 wherein the ionic surfactants further comprise 15–16% of calcium dodecyl sulfonate.

6. The additive used in a water/hydrocarbon mixture according to claim 1 further comprises tert-butyl peroxide.

7. The additive used in a water/hydrocarbon mixture according to claim 1 wherein the water/hydrocarbon mixture is made of water that is magnetized under 4000–5000 Gauss.

8. The water/hydrocarbon mixture as a combustible fuel according to claim 4 wherein said additive further comprises tert-butyl peroxide.

9. The water/hydrocarbon mixture as a combustible fuel according to claim 4 wherein the water/hydrocarbon mixture is made of water that is magnetized at 4000–5000 Gauss.

10. The water/hydrocarbon mixture as a combustible fuel according to claim 4 wherein the ionic surfactants further comprise 20–35% of tris-(2-hydroxyethyl)amine by weight of said additive.

* * * * *